US006634621B2

(12) United States Patent
Keith

(10) Patent No.: US 6,634,621 B2
(45) Date of Patent: Oct. 21, 2003

(54) LIFTING DEVICE AND A METHOD FOR LIFTING BY USING THE SAME

(76) Inventor: Malcolm E. Keith, 355 Kirkland Dr., Algonquin, IL (US) 60102

( * ) Notice: Subject to any disclaimer, the term of this patent is extended or adjusted under 35 U.S.C. 154(b) by 0 days.

(21) Appl. No.: 09/922,576

(22) Filed: Aug. 3, 2001

(65) Prior Publication Data

US 2003/0025110 A1 Feb. 6, 2003

(51) Int. Cl.[7] ..... B66D 1/48
(52) U.S. Cl. ..... 254/270; 254/334
(58) Field of Search ..... 254/270, 267, 254/334, 362, 269, 271, 273

(56) References Cited

U.S. PATENT DOCUMENTS 2,989,288 A * 6/1961 Smith ..... 254/334
3,850,380 A * 11/1974 Kranefeld ..... 254/271
3,921,959 A * 11/1975 Ulbing ..... 254/168
3,940,110 A * 2/1976 Motoda ..... 254/270
3,964,182 A * 6/1976 Pomeret et al. ..... 37/466
4,213,019 A * 7/1980 Houp ..... 200/61.13
4,448,394 A * 5/1984 LeMoine ..... 254/271
4,557,659 A * 12/1985 Scaglia ..... 414/627
5,522,581 A * 6/1996 Kulhavy ..... 254/267
5,632,469 A * 5/1997 Heun et al. ..... 254/267
5,662,311 A * 9/1997 Waedekin et al. ..... 254/273
5,865,426 A * 2/1999 Kazerooni ..... 254/270
5,915,673 A * 6/1999 Kazerooni ..... 254/270
6,299,139 B1 * 10/2001 Kazerooni ..... 254/270
6,386,513 B1 * 5/2002 Kazerooni ..... 254/270

* cited by examiner

*Primary Examiner*—Emmanuel Marcelo
(74) *Attorney, Agent, or Firm*—Patents +TMS, P.C.

(57) ABSTRACT

A lifting device for lifting and moving objects with minimal effort and a method for using the same is provided. The lifting device has a cable attachable to an object and a handle on the cable. Sensors in the handle may sense vertical pressure exerted on the handle and may put out a current to a variable-speed motor in a housing of the lifting device. The motor may release or may retrieve the cable at a speed dependent upon the amount of pressure applied, thereby raising or lowering the object. Pressure of three to five pounds is sufficient to lift any object. The operator may move the object in any direction up to a radius determined by the length of the cable from the object to the housing. The housing may have an upper portion that may slide forward relative to a lower portion. Consequently, this lengthens the radius of movement allowed to the operator.

17 Claims, 7 Drawing Sheets

LIFTING DEVICE AND A METHOD FOR LIFTING BY USING THE SAME

BACKGROUND OF THE INVENTION

The present invention generally relates to a lifting device for lifting and/or moving objects and a method for lifting by using the same. More specifically, the present invention relates to a lifting device wherein an operator may lift and/or move an object in any direction using minimal effort.

It is known in the art to provide lifting devices for moving objects. For example, cranes are commonly used to lift and move objects during construction or for other industrial uses. However, cranes are often cumbersome and not suitable for precise movements of objects.

Other lifting devices for moving objects are also known. For example, a lifting device manufactured and/or sold by Gorbal, Inc. is designed to move objects and is operated by an individual. The individual, using the Gorbal device, may lift an object with little pressure applied to the device in comparison to the amount of weight being lifted or moved. However, the lifting device by Gorbal, is not free-standing and must be attached to a bridge or a crane. Further, the operator may move the object vertically with the Gorbal device but must move the Gorbal device for horizontal movement of the object. For example, the device may be moved in a horizontal direction by manipulating the bridge and/or crane from which the Gorbal device is attached. Accordingly, movement of the object, in any direction, by the Gorbal device is not possible.

The lifting device by Gorbal and any other lifting devices known in the industry do not allow for the lifting of objects with minimal effort by an individual that also allows the individual to directly move the object in any direction. An operator, for example, may use the Gorbal device to lift an object in the vertical direction. After lifting the object in the vertical direction, if the operator wishes to move the object in a horizontal direction, for example, the operator must move the crane or bridge or other structure to which the device is attached.

Further, the device of the present invention allows for workers, such as, for example, workers in a factory assembly line, construction workers, or the like, to minimize work place injuries associated with repeatedly lifting objects. In an industry where machine parts must be lifted onto, for example, a conveyor belt or a platform to be worked upon by laborers or machines, repetitive lifting is required to move the objects on and off a machining area. This process is both difficult and labor intense. The placement of the object is often required to be precise and exact which often requires re-positioning of the object multiple times to effect the exact placement of the same.

A need, therefore, exists for a lifting device which allows an individual to lift and/or move objects in any direction and a method for lifting by using the same.

SUMMARY OF THE INVENTION

The present invention generally relates to a lifting device for lifting and/or moving objects and a method for lifting by using the same. More specifically, the present invention relates to a lifting device wherein an operator may lift and/or move an object in any direction using minimal effort in comparison to the weight of the object being lifted and/or moved.

In an embodiment of the present invention a lifting device for lifting by using the same is provided in which a cable is connected to the object, a handle is associated with the cable, a first sensor in the handle produces a first signal in response to pressure on the handle. Additionally, a second sensor in the handle produces a second signal in response to a pressure on the handle. The controller receives the first signal and the second signal and produces an ouptut signal and a motor responsive to the output signal from the controller controls movement of the cable based on the output signal.

In an embodiment, a roller on which the cable is provided.

In an embodiment, a third sensor associated with the cable is provided wherein the third sensor produces a signal indicative of presence of the cable and sends the signal to the controller.

In an embodiment, a spring associated with the handle is provided.

In an embodiment, a housing having a top portion and a bottom portion wherein the housing supports the roller is provided.

In an embodiment, tracks are provided wherein the top portion of the housing moves on the tracks relative to the bottom portion of the housing.

In an embodiment, the first sensor is a non-contact sensor.

In an embodiment, the second sensor is a non-contact sensor.

In an embodiment of the present invention a method for lifting or moving an object is provided wherein a cable having a first end and a second end is provided and wherein the object is connected to the first end of the cable. Additionally, a roller is provided and connected to the second end of the cable. Still further, a handle associated with the cable is provided wherein the handle has a first sensor and a second sensor and wherein each of the first sensor and the second sensor produce a signal indicative of pressure applied to the handle. Still further a motor is provided and moves the object with the motor based on the signal from either of the first sensor and the second sensor.

In an embodiment, a housing is provided wherein the housing supports the roller.

In an embodiment, the housing along tracks.

In an embodiment, a third sensor is provided wherein the third sensor senses presence of the cable and produces a signal indicative thereof.

In an embodiment of the present invention a lifting device for lifting and/or moving an object is provided wherein a cable is connected to the object and a handle associated with the cable. Further, a roller is provided wherein the cable is wound on the roller and wherein the roller releases and retrieves the cable. Further, a cable sensor associated with the roller is provided wherein the sensor detects presence of the cable on the roller producing a cable signal indicative thereof and the controller that receives the cable signal from the cable sensor produces an output signal. Still further, a motor responsive to the output signal from the controller is provided wherein the motor controls movement of the cable based on the output signal.

In an embodiment, a first sensor in the handle is provided wherein the first sensor produces a first signal indicative of a pressure on the handle.

In an embodiment, a second sensor in the handle is provided wherein the second sensor produces a second signal indicative of a pressure applies to the handle.

In an embodiment, a spring associated with the handle is provided.

In an embodiment, tracks associated with the housing are provided wherein the housing moves on the tracks.

It is, therefore, an advantage of the present invention to provide a lifting device and a method for lifting by using the same wherein an individual may lift and/or move an object using minimal effort in comparison to the weight of the object.

Another advantage of the present invention is to provide a lifting device and a method for lifting by using the same wherein an individual may lift and/or move an object with minimal strain to the body.

A still further advantage of the present invention is to provide a lifting device and a method for lifting by using the same wherein an individual may lift and/or move an object quickly and precisely.

Yet another advantage of the present invention is to provide a lifting device and a method for lifting by using the same wherein an individual may lift and/or move an object repeatedly without strain to the body.

Another advantage of the present invention is to provide a lifting device and a method for lifting by using the same wherein an individual may lift and/or move an object in a horizontal direction and vertical direction.

A still further advantage of the present invention is to provide a lifting device and a method for lifting by using the same wherein an individual may lift and/or move an object in an angle of direction ranging from zero degrees to 360 degrees.

Yet another advantage of the present invention is to provide a lightweight portable device for lifting and/or moving an object.

Another advantage of the present invention is to provide a lifting device and a method for lifting by using the same wherein the lifting device is easy to use.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention relates generally to a lifting device for lifting and/or moving objects and a method for lifting by using the same. More specifically, the present invention relates to a lifting device wherein an operator may lift and/or move an object in any direction using minimal effort in comparison to the weight of the object.

The lifting device may be designed for easily and/or quickly moving objects while maintaining a smooth and stable lift. As a result, exact positioning of the object that is being moved may be achieved by the operator. The force that the operator exerts to lift a load may be significantly less than the weight of the object or load. For example, a 150 pound load may be lifted and/or moved using as little as three pounds of pressure. The lifting device may allow the operator to move the load as quickly or as slowly as the operator wants regardless of the weight of the load.

The lifting device may increase an operator's physical power by extending mechanical power to the lifting task. The lifting device may mimic the movement of the operator's arm. If the operator moves his arm upward and to the right, the lifting device moves the load upward and to the right. The speed that the operator moves his arm is the speed at which the lifting device moves the load. Thus, the lifting device may act as an extension of the operator's arm.

Figure 1:
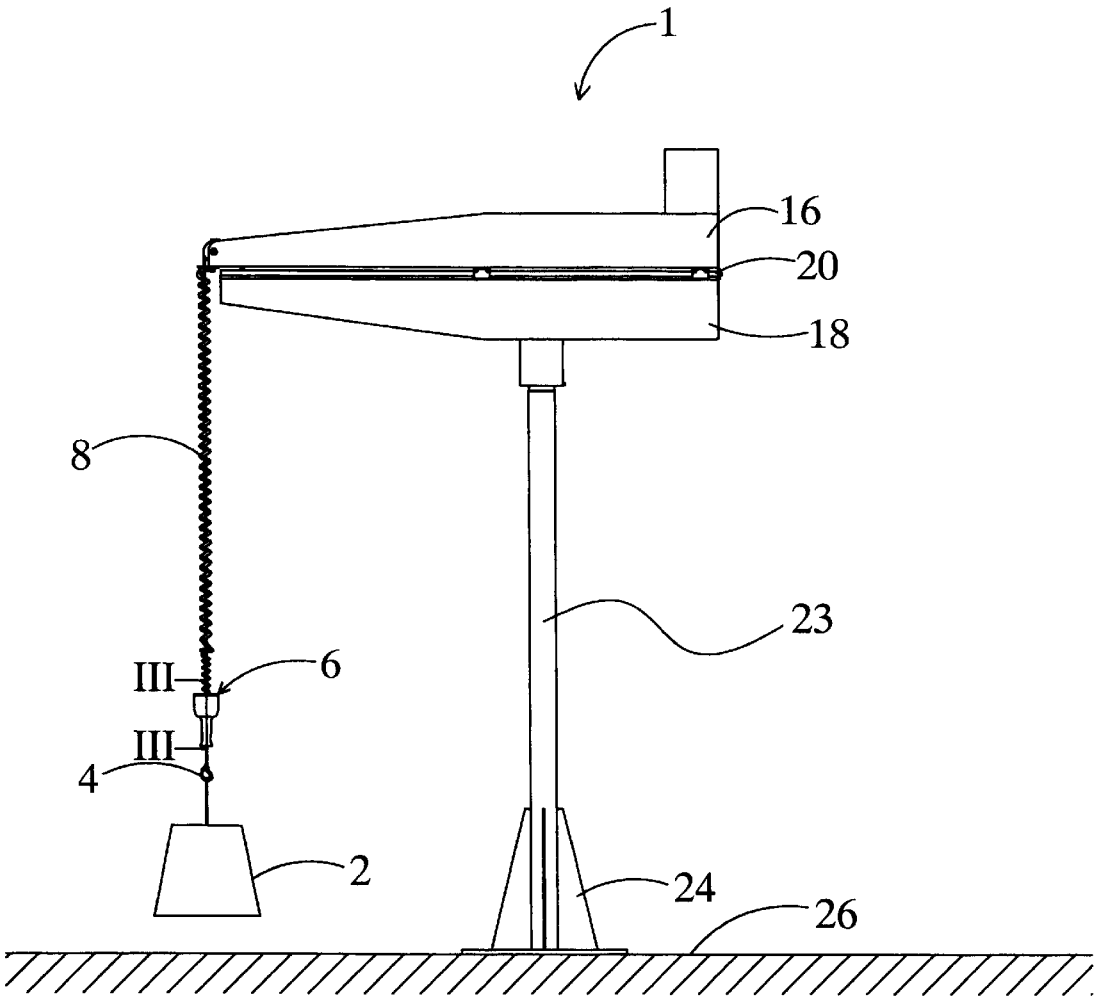
FIG. 1 illustrates a side view of an embodiment of a lifting device of the present invention.
Figure 2:
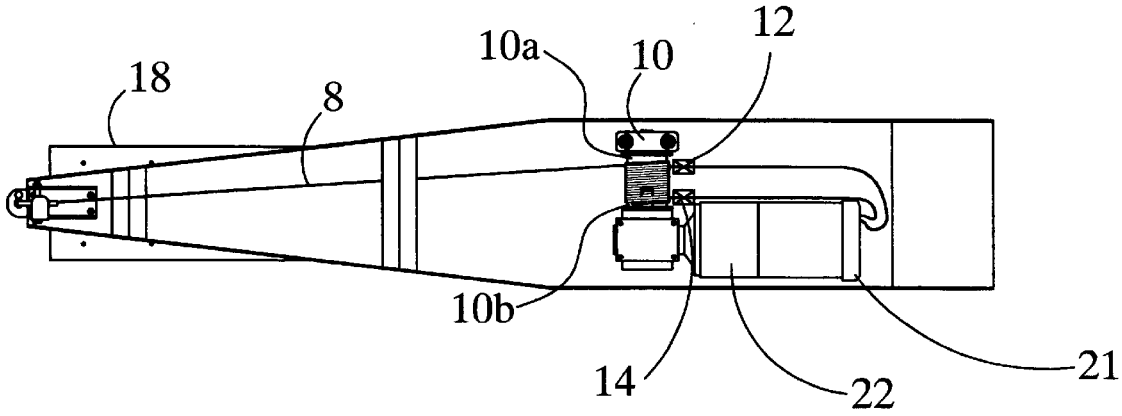
FIG. 2 illustrates a top view of an embodiment of a lifting device of the present invention.
Figure 4:
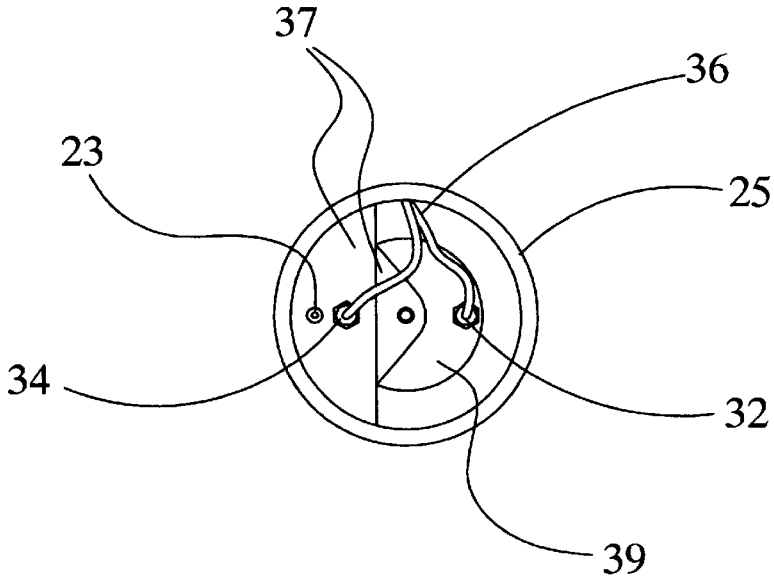
FIG. 4 illustrates a cross-sectional view taken generally along the line IV—IV of FIG. 3 in an embodiment of a handle of the lifting device of the present invention.

Referring to the drawings wherein like numerals refer to like parts, FIG. 1 generally illustrates a lifting device 1. A weight 2, or load, or other like object may be connected to the lifting device by a connector 4. The connector 4 may be a hook, magnet, clamp, or any type of connecting device known in the art used to secure or pick up the weight 2. A handle 6 may be connected to the connector 4 via a cable 8. The cable 8 may extend from the connector 4 to a handle 6 and from the handle 6 to a spool 10 on which the cable 8 is wound as shown in FIG. 2. The spool 10 may be located on a top portion 16 of the lifting device 1.

Referring to FIG. 2, a motor 22 may power the spool 10 which may release the cable 8 and/or which may retrieve the cable 8. A first sensor 12 and a second sensor 14 may detect when the cable 8 has reached a vertical limit. The first sensor 12 and the second sensor 14 may each detect presence or absence of the cable 8, respectively. If the first sensor 12 detects the cable 8 on the spool 10, the first sensor 12 may send a signal to the controller 21. The first sensor 12 maybe located near a top end 10*a* of the spool 10. The detection of the presence of the cable 8 at the top end 10*a* of the spool 10 by the first sensor 12 is an indication that the cable 8 reached a vertical limit. The first sensor 12 may signal to the controller 21 the presence of the cable 8, and the controller 21 may signal the motor 22 to stop. To this end, the motor 22 may be attached to the spool 10 and may power the spool 10 such that the spool 10 may retrieve and/or release the cable 8.

The second sensor 14 maybe located near a bottom end 10*b* of the spool 10. If the second sensor 14 detects the absence of the cable 8, the second sensor 14 may send a signal to the controller 21. Because of the location of the second sensor 14 near the bottom end 10*b* of the spool 10, the detection of the absence of cable 8 at the bottom end 10*b* of the spool 10 is an indication that the cable 8 reached a vertical limit. If the controller 21 receives a signal from the second sensor 14, the controller 21 may send a signal to the motor 22 to stop the spool 10 from releasing the cable 8. The controller 21 may, therefore, control speed and/or operation of the motor 22.

Figure 6:
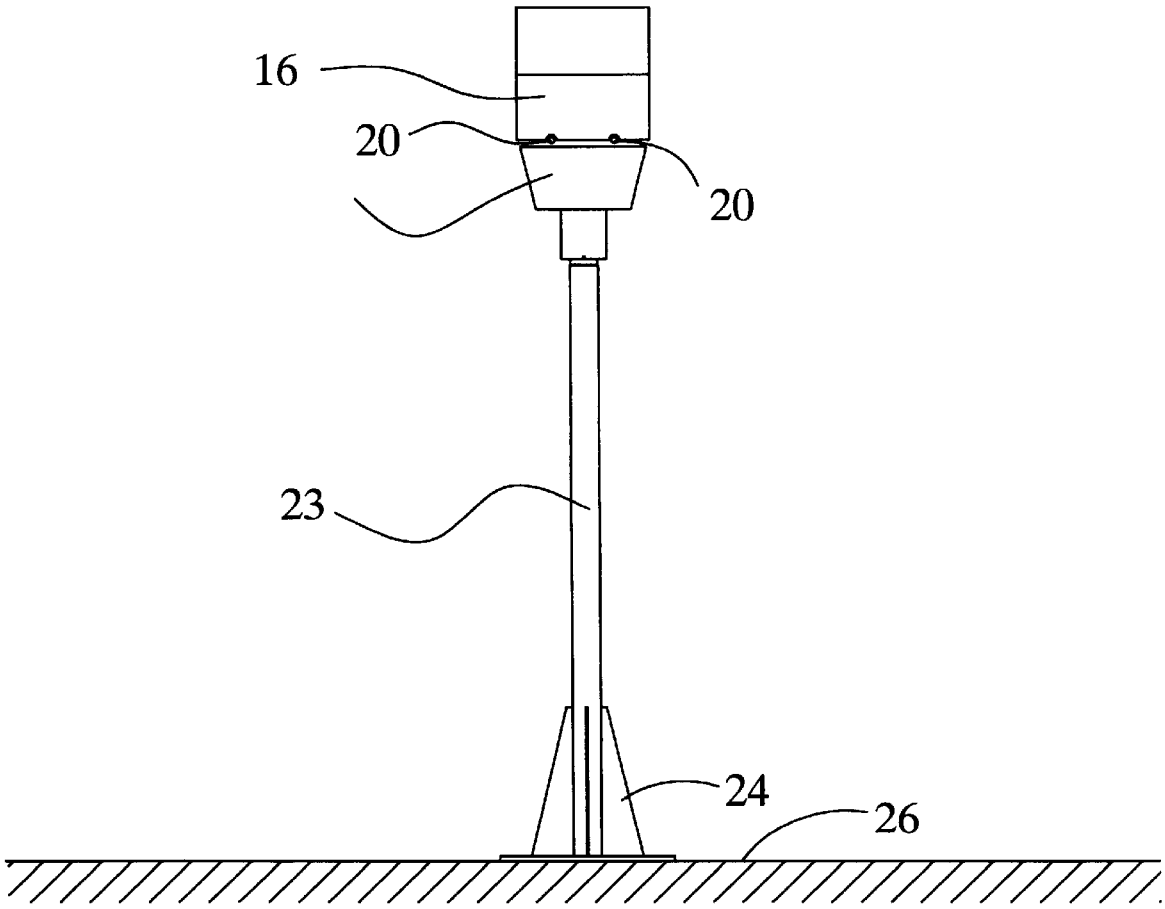
FIG. 6 illustrates a back view of an embodiment of a lifting device of the present invention.

Referring to FIG. 6 and again to FIG. 1, the top portion 16 may be constructed to fit on rods 20 attached to a bottom portion 18 of the lifting device 1. The rods 20 act as tracks in which the top portion 16 may slide forward along the rods 20 relative to the bottom portion 18. The bottom portion 18 may be fixed to the rods 20, and the bottom portion 18 may not move relative to the rods 20. When the lifting device of the present invention is in use, an operator may pull the handle 6 which may exert a pulling force on the top portion 16 via the cable 8. The pulling force may precipitate the forward and/or backward movement of the top portion 16 along the rods 20 relative to the bottom portion 18. The bottom portion 18 may be supported by a pole 23 attached to a base 24 mounted to a surface 26, such as, for example, a floor, a ceiling, or other stable surface.

Referring now to FIGS. 3A, 3B, 3C and 4, the handle 6 of the lifting device 1 is generally illustrated. The handle 6 may have a hand grip 28 attached to a cup 25 by a first screw 27*a* and a second screw 27*b*. A steel plate 35 may be attached to the inside of the cup 25 by the second screw 27*b*. A third screw 23 may attach a plate 37 to the cup 25.

The cable 8, as discussed previously, and as shown in FIGS. 1 and 2, may be attached to the weight 2 at one end and to the spool 10 at another end. The cable 8 may also be attached to the handle 6 by a set screw 43. The set screw 43 may attach the cable 8 to a cable grip 39 housed inside the cup 25 of the handle 6. The cable 8 extends from the set screw 43 to the weight 2 and from the set screw 43 to the spool 10.

Figure 3A:
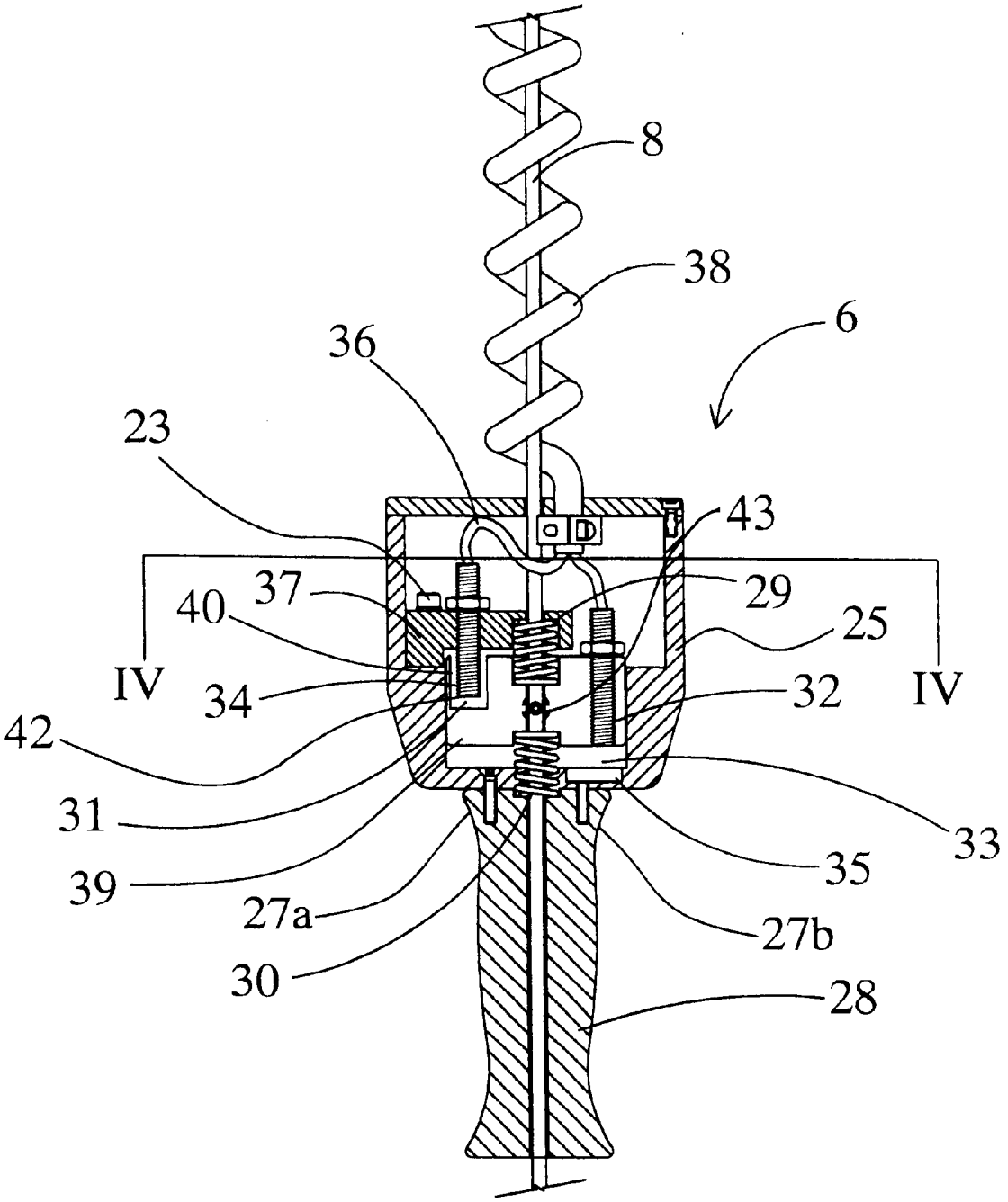
FIGS. 3A, 3B and 3C illustrate cross-sectional views taken generally along the line III—III of FIG. 1 in an embodiment of a handle of the lifting device of the present invention.

An up sensor 34 may be attached to the plate 37 and may extend through the plate 37 into a cavity 40 inside the cable grip 39. Between a bottom 42 of the up sensor 34 and the cavity 40 may be a gap 31. A down sensor 32 may be attached to the cable grip 39 and may extend through the cable grip 39. The down sensor 32 may be a distance 33 above the steel plate 35. The steel plate 35 may be attached to the inside of the cup 25 by the second screw 27*b*. A first spring 29 may encircle the cable 8 and may be located between the plate 37 and the cable grip 39. A second spring 30 may encircle the cable 8 and may be located between the cable grip 39 and the handle grip 28. The first spring 29 and the second spring 30, when not under any outside pressure, as shown in FIG. 3A, may hold the handle 6 in a neutral position.

Figure 3B:
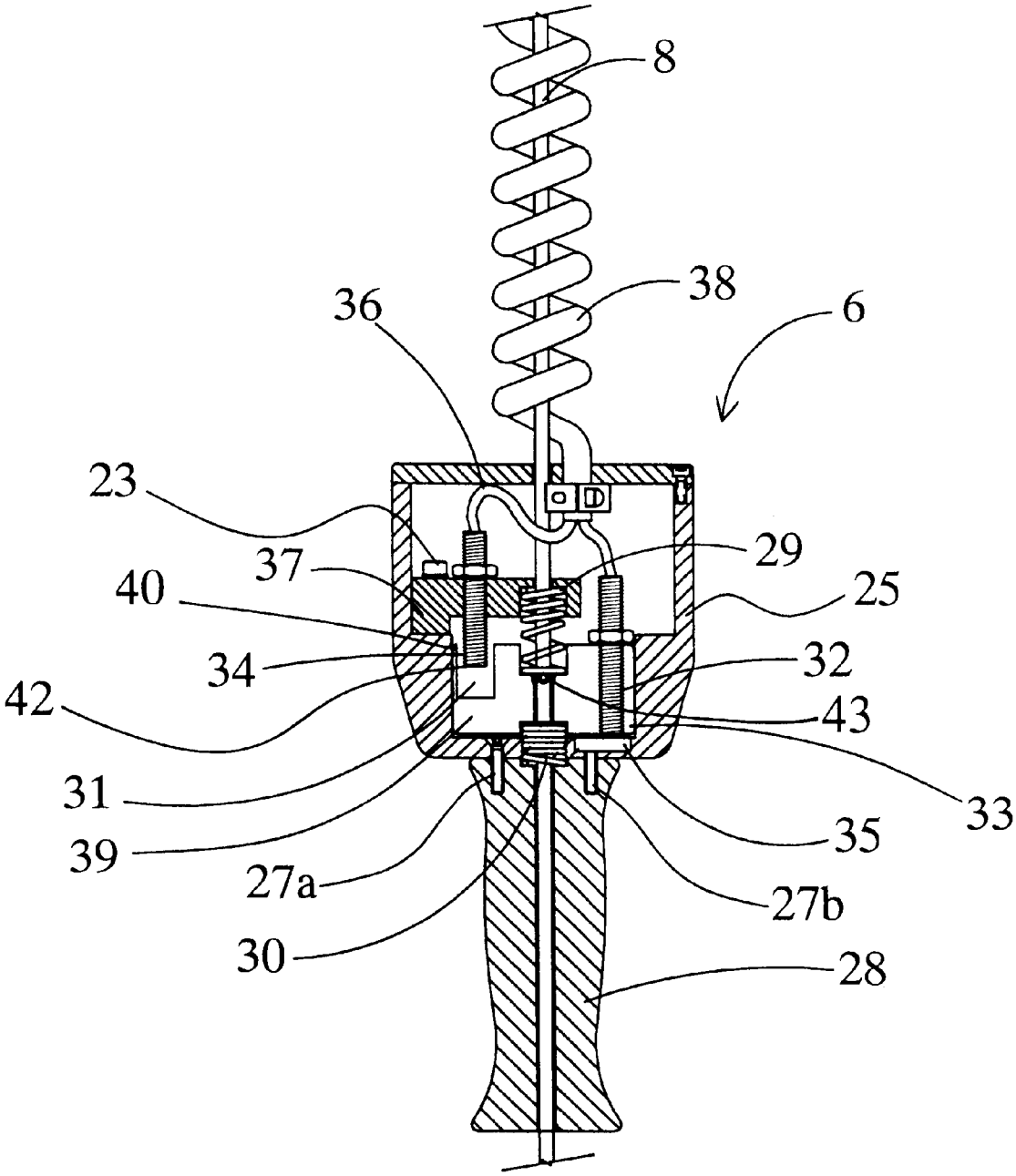

After an operator, for example, holds the hand grip 28 of the handle 6 and raises the hand grip 28, or exerts as little as three pounds of pressure in a vertical upward direction, the weight 2 (see FIG. 1) may be lifted. After an upward pressure is applied to the hand grip 28, the hand grip 28 may raise. This, in turn, may raise the cup 25. As a result, this may raise the plate 37 which, in turn, may raise the up sensor 34. The raised up sensor 34 may result in an increase in the gap 31 between the up sensor 34 and the cable grip 39. This may result from relaxing of the spring 29 and compression of the spring 30. When the spring 29 is relaxed and the spring 30 is compressed, the handle 6 may be in an upward position as shown in FIG. 3B.

Figure 3C:
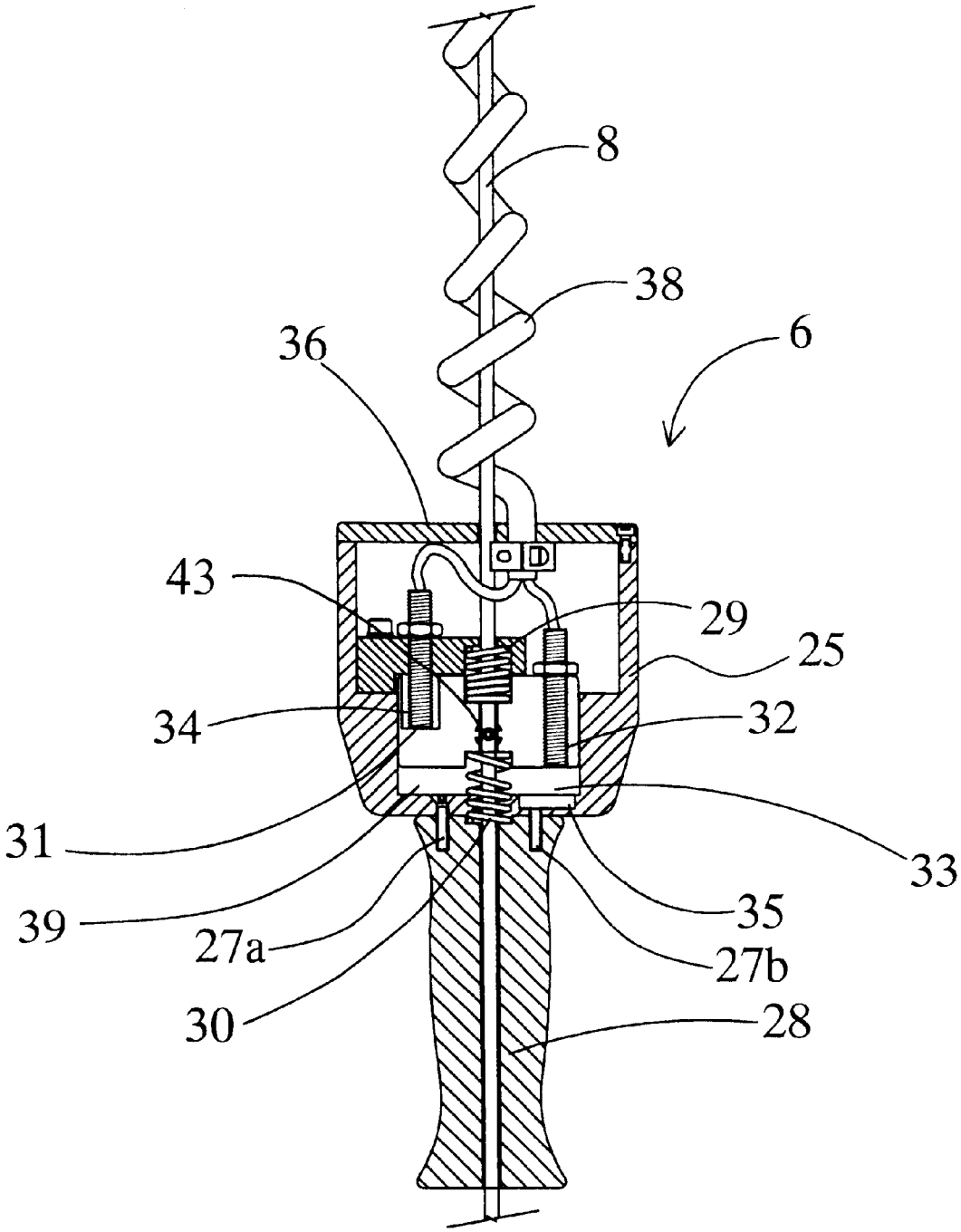

After a downward pressure is applied to the hand grip 28, the hand grip 28 may lower. This may lower the cup 25 which, in turn, may lower the steel plate 35. The lowered steel plate 35 may result in an increase in the distance 33 between the steel plate 35 and the downward sensor 32. This may result in relaxing of the spring 30 and compression of the spring 29. When the spring 30 is relaxed and the spring 29 is compressed, the handle 6 may be in a downward position as shown in FIG. 3C. When the spring 29 and the spring 30 are in equal states of compression, the handle 6 is in a neutral position.

Accordingly, applying an upward pressure to the handle 6 may result in an increase in the gap 31 between the up sensor 34 and the cable grip 39. Consequently, this may result in a decrease in the distance 33 between the steel plate 35 and the down sensor 32. Conversely, applying a downward pressure to the handle 6 may result in a decrease in the gap 31 between the up sensor 34 and the cable grip 39. Consequently, this may result in an increase in the distance 33 between the steel plate 35 and the down sensor 32.

The up sensor 34 may detect a decreasing gap 31 and may send a variable current (not illustrated) via wires 36. The down sensor 32 may detect a decreasing distance 33 and may send a variable current (not illustrated) via wires 36. The wires 36 carry the current through the retractable cord 38 to the controller 21. The controller 21 may then send a signal to the motor 22 to turn the spool 10 such that the cable 8 may be retrieved or released. As a result, this raises or lowers the handle 6 and the weight 2, respectively.

As discussed previously, the first sensor 12 may detect when a maximum amount or other predetermined amount of the cable 8 has been retrieved. Further, the second sensor 14 may detect when the maximum amount or other predetermined amount of the cable 8 has been released. Accordingly, the controller 21 may then stop the motor 22 from powering the spool 10 to retrieve or release the cable 8, respectively. This happens regardless of the pressure applied to the handle 6.

Figure 5:
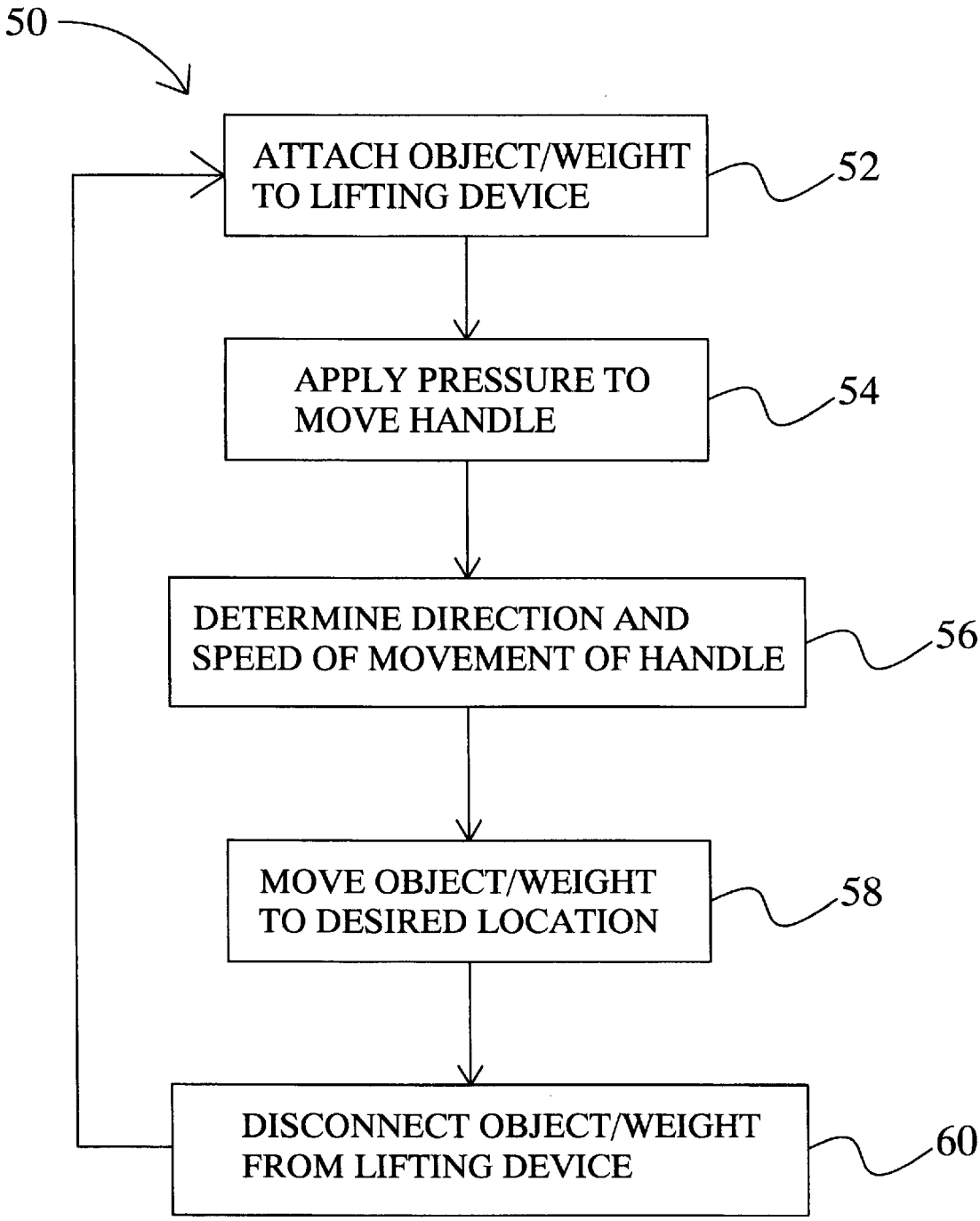
FIG. 5 illustrates a flowchart of a method for lifting using a lifting device in an embodiment of the present invention.

Referring now to FIG. 5, a method 50 for lifting using the lifting device 1 of the present invention is generally illustrated. To use the lifting device 1 of the present invention, an operator may attach or otherwise secure or connect the weight 2 or any object to the lifting device 1 by the connector 4 via step 52. After the object is attached to the lifting device 1, the operator may apply pressure in either an upward or downward direction to the handle 6 via step 54. At this stage, a signal is generated to determine if the object should be raised or lowered and the speed at which movement should occur. The pressure may be minimal in comparison to the weight of the object. After applying pressure to the handle 6, the lifting device 1 may raise or lower the object at a specified speed, as shown at step 56, based on a signal detected at step 54. The amount of pressure that the operator applies to the handle 6 may correspond to the speed at which the lifting device 1 lifts or lowers the object or weight 2. The amount of pressure applied by the operator may be directly proportional to the speed in which the lifting device 1 may raise and/or lower the object. Therefore, an increase in the amount of pressure applied by the operator may yield an increase in the speed in which the lifting device 1 may raise and/or lower the object.

The operator may move the handle 6 of the lifting device 1 such that when the operator moves the handle 6, the cable 8 attached to the handle 6 may move in a direction following the movement of the operator. The weight 2, as a result, may also be moved to any location in which the handle is moved thereby moving the object to the desired location as shown at step 58. The operator may then carry the weight 2 or object without exerting any additional pressure by merely moving the weights 2 to the desired location while holding the handle 6. The operator may move the weight 2 in any direction within a radius equal to the length of the cable 8 extending from the top portion 16 to the handle 6.

In addition, as discussed previously, the top portion 16 of the lifting device 1 may slide forward relative to the bottom portion 18. An extended top portion 16 of the lifting device 1 may extend the radius of movement allowed to the operator when lifting and moving the weight 2.

After the object has been precisely located in its desired position, the operator may disconnect the object from the lifting device as shown at step 60. The operator may then repeat the process by attaching another object to the lifting device via step 52 and repeating steps 54 to 60.

It should be understood that various changes and modifications to the presently preferred embodiments described herein will be apparent to those skilled in the art. Such changes and modifications may be made without departing from the spirit and scope of the present invention and without diminishing its attendant advantages.

I claim:

1. A lifting device for lifting and/or moving an object, the lifting device comprising:

a cable connected to the object;

a handle attached to the cable wherein the cable extends through the handle;

a first sensor in the handle wherein the first sensor produces a first signal in response to pressure on the handle;

a second sensor in the handle wherein the second sensor produces a second signal in response to a pressure on the handle;

a controller that receives the first signal and the second signal and produces an output signal; and a motor responsive to the output signal from the controller wherein the motor controls movement of the cable based on the output signal.

2. The lifting device of claim 1 further comprising:

a roller on which the cable is provided.

3. The lifting device of claim 2 further comprising:

a housing having a top portion and a bottom portion wherein the housing supports the roller.

4. The lifting device of claim 3 further comprising:

tracks wherein the top portion of the housing moves on the tracks relative to the bottom portion of the housing.

5. The lifting device of claim 1 further comprising:

a third sensor associated with the cable wherein the third sensor produces a signal indicative of presence of the cable and sends the signal to the controller.

6. The lifting device of claim 1 further comprising:

a spring associated with the handle.

7. The lifting device of claim 1 wherein the first sensor is a non-contact sensor.

8. The lifting device of claim 1 wherein the second sensor is a non-contact sensor.

9. A method for lifting or moving an objects the method comprising the steps of:

providing a cable having a first end and a second end;

connecting the object to the first end of the cable;

providing a roller;

connecting the roller to the second end of the cable;

providing a handle associated with the cable wherein the handle has a first sensor and a second sensor wherein each of the first sensor and the second sensor produce a signal indicative of pressure applied to the handle;

providing a motor; and moving the object with the motor based on the signal from either of the first sensor and the second sensor.

10. The method of claim 9 further comprising the step of:

providing a housing wherein the housing supports the roller.

11. The method of claim 9 further comprising the step of:

moving the housing along tracks.

12. The method of claim 9 further comprising the step of:

providing a third sensor wherein the third sensor senses presence of the cable and produces a signal indicative thereof.

13. A lifting device for lifting and/or moving an object, lifting device comprising:

a cable connected to the object;

a handle attached to the cable wherein the cable extends through the handle;

a roller wherein the cable is wound on the roller and wherein the roller releases and retrieves the cable a cable sensor associated with the roller wherein the sensor detects presence of the cable on the roller producing a cable signal indicative thereof;

a controller that receives the cable signal from the cable sensor and produces an output signal; and a motor responsive to the output signal from the controller wherein the motor controls movement of the cable based on the output signal.

14. The lifting device of claim 13 further comprising:

a first sensor in the handle wherein the first sensor produces a first signal indicative of a pressure on the handle.

15. The lifting device of claim 13 further comprising:

a second sensor in the handle wherein the second sensor produces a second signal indicative of a pressure applies to the handle.

16. The lifting device of claim 13 further comprising:

a spring associated with the handle.

17. The lifting device of claim 13 further comprising:

tracks associated with the housing wherein the housing moves on the tracks.

* * * * *